US008966713B1

(12) United States Patent
Russo et al.

(10) Patent No.: US 8,966,713 B1
(45) Date of Patent: Mar. 3, 2015

(54) ADJUSTABLE SELF-CLOSING FENCE HINGE

(71) Applicant: Barrette Outdoor Living, Inc., Middleburg Heights, OH (US)

(72) Inventors: Daniel Russo, Brecksville, OH (US); Antonello Nizzia, Turin (IT)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 14/099,014

(22) Filed: Dec. 6, 2013

(51) Int. Cl.
*E05F 1/14* (2006.01)
*E05F 1/10* (2006.01)
*E05D 7/00* (2006.01)

(52) U.S. Cl.
CPC ..... *E05F 1/10* (2013.01); *E05D 7/0018* (2013.01)
USPC ..... 16/285; 16/50; 16/298; 16/301

(58) Field of Classification Search
USPC ..... 16/50, 76, 85, 298–301, 285, 295, 307, 16/308, 386, DIG. 10; 49/386
See application file for complete search history.

(56) References Cited

U.S. PATENT DOCUMENTS

| | | | | | |
|---|---|---|---|---|---|
| 924,422 | A | | 6/1909 | Bommer | |
| 1,127,688 | A | | 2/1915 | Smith | |
| 1,810,534 | A | * | 6/1931 | Rubin | 16/301 |
| 2,072,094 | A | * | 3/1937 | Bommer et al. | 16/299 |
| 2,248,493 | A | | 7/1941 | Curtiss, Jr. | |
| 2,629,881 | A | * | 2/1953 | Young | 4/240 |
| 2,777,157 | A | | 1/1957 | Burke | |
| 3,510,986 | A | * | 5/1970 | Berkowitz | 49/386 |
| 3,825,973 | A | * | 7/1974 | Gwozdz | 16/300 |
| 4,339,845 | A | * | 7/1982 | Newlon et al. | 16/300 |
| 4,419,788 | A | * | 12/1983 | Prout | 16/300 |
| 4,570,291 | A | | 2/1986 | Smith et al. | |
| 4,574,715 | A | | 3/1986 | Dietrich, Sr. et al. | |
| 4,583,262 | A | * | 4/1986 | Werner | 16/300 |
| 4,589,164 | A | * | 5/1986 | Leonard | 16/299 |
| 4,845,811 | A | * | 7/1989 | Fargnier | 16/308 |
| 5,048,155 | A | * | 9/1991 | Hwang | 16/301 |
| 5,191,729 | A | | 3/1993 | Verseef | |
| 5,991,975 | A | | 11/1999 | Baer | |
| 6,178,694 | B1 | | 1/2001 | Wagnitz | |
| 6,618,902 | B2 | * | 9/2003 | Wu | 16/298 |
| 6,752,438 | B2 | | 6/2004 | DeSouza | |
| 7,210,199 | B2 | * | 5/2007 | Clark | 16/299 |
| 7,516,519 | B2 | * | 4/2009 | Talpe | 16/316 |
| 8,245,353 | B2 | * | 8/2012 | Homner et al. | 16/299 |
| 8,534,625 | B2 | | 9/2013 | Heath et al. | |
| 8,549,707 | B2 | * | 10/2013 | Macernis | 16/301 |
| 8,683,654 | B2 | * | 4/2014 | Chen | 16/301 |
| 8,745,820 | B2 | * | 6/2014 | Janak | 16/54 |
| 8,752,247 | B2 | * | 6/2014 | Franchini | 16/334 |
| 2003/0200623 | A1 | | 10/2003 | Hung | |
| 2004/0093689 | A1 | | 5/2004 | Sosa et al. | |
| 2008/0179580 | A1 | | 7/2008 | McGinness et al. | |
| 2011/0099754 | A1 | | 5/2011 | Stull | |

FOREIGN PATENT DOCUMENTS

| | | |
|---|---|---|
| WO | 9015912 | 12/1990 |
| WO | 2012174039 A1 | 12/2012 |

* cited by examiner

*Primary Examiner* — William Miller
(74) *Attorney, Agent, or Firm* — Luedeka Neely Group, PC

(57) ABSTRACT

An adjustable hinge includes a hinge housing rotatably mounted relative to a body, a spring located within the hinge housing, and a spring adjustment system. The spring adjustment system includes a pin having a head including a plurality of projections about a circumference of the head and an opposite end of the pin spaced from the head.

12 Claims, 13 Drawing Sheets

ADJUSTABLE SELF-CLOSING FENCE HINGE

FIELD

This disclosure relates to the field of fence hinges. More particularly, this disclosure relates to a fence hinge system configured to have an adjustable spring tension.

BACKGROUND

Gate hinges for fences desire improvement. Conventional self-closing (or self-opening) gate hinges desire improvement in that they are difficult to adjust the spring tension, or to wholly remove spring tension.

The present disclosure advantageously provides a spring-loaded fence hinge system that enables convenient adjustment of the spring tension, including complete removal of spring tension.

SUMMARY

The above and other needs are met by an adjustable hinge.

In one aspect, the hinge includes a hinge housing rotatably mountable relative to a body; a spring located within the hinge housing, the spring having a first end and an opposite second end, the second end of the spring being fixed relative to the hinge housing; and a spring adjustment system.

The spring adjustment system includes a pin having a head including a plurality of projections about a circumference of the head and an opposite end of the pin spaced from the head, the pin positioned to cooperate with the spring so that a first end of the spring is fixed relative to the head of the pin so that when the head of the pin is rotated the first end of the spring also rotates, and a pin retainer fixedly located relative to the housing and including a bore configured to receive the head of the pin, the bore including a plurality of recesses configured to receive the projections of the head of the pin.

Tension of the spring is fixed when the pin head is seated in the bore of the pin retainer with the projections of the head of the pin received in the recesses of the bore. Tension of the spring is adjustable by withdrawing the projections of the head from engagement with the recesses of the bore of the pin retainer, then rotating the head of the pin to wind or unwind the spring to adjust the tension of the spring, and then positioning the projections of the head into engagement with the recesses of the bore of the pin retainer, thereby fixing the tension of the spring at the adjusted tension.

In another aspect, there is provided an adjustable self-closing hinge that includes a hinge housing rotatably mountable relative to a body by a hinge mount; a spring located within the hinge housing, the spring having a first end and an opposite second end, the second end of the spring being fixed relative to the hinge housing; and a spring adjustment system.

The spring adjustment system includes a pin having a head including a plurality of projections about a circumference of the head and an opposite end of the pin spaced from the head, the pin positioned to cooperate with the spring so that a first end of the spring is fixed relative to the head of the pin so that when the head of the pin is rotated the first end of the spring also rotates, a fastener removably positionable on the opposite end of the pin, and a first pin retainer fixedly located adjacent an end of the housing and including a bore configured to receive the head of the pin, the bore including a plurality of recesses configured to receive the projections of the head of the pin.

Tension of the spring is fixed when the pin head is seated in the bore of the pin retainer with the projections of the head of the pin received in the recesses of the bore. Tension of the spring is adjustable by removing the fastener from the opposite end of the pin and withdrawing the projections of the head from engagement with the recesses of the bore of the first pin retainer, then rotating the head of the pin to wind or unwind the spring to adjust the tension of the spring, and then by installing the fastener onto the opposite end of the pin and positioning the projections of the head into engagement with the recesses of the bore of the first pin retainer, thereby fixing the tension of the spring at the adjusted tension.

In yet another aspect, a self-closing hinge according to the disclosure includes a base plate attachable to a fence post, the base plate having a first wall mountable to the fence post and a pair of vertically spaced apart and aligned first hinge mounts extending outwardly from the first wall; a swing arm attachable to a fence gate, the swing arm having a second wall mountable to the gate; and a hinge mounted to the base plate and the swing arm for hingedly connecting the base plate and the swing arm.

The hinge includes a hinge housing vertically oriented and rotatably mounted to the first hinge mounts, an extension member having a first portion connected to the hinge housing and a second portion mounted to the swing arm, a spring located within the hinge housing, the spring having a first end and an opposite second end, the second end of the spring being fixed relative to the hinge housing, and a spring adjustment system.

The spring adjustment system includes a pin having a head including a plurality of projections about a circumference of the head and an opposite end of the pin spaced from the head, the pin positioned to cooperate with the spring so that a first end of the spring is fixed relative to the head of the pin so that when the head of the pin is rotated the first end of the spring also rotates, a fastener removably positionable adjacent the opposite end of the pin, and a first pin retainer fixedly located adjacent an end of the housing and including a bore configured to receive the head of the pin, the bore including a plurality of recesses configured to receive the projections of the head of the pin.

Tension of the spring is fixed when the pin head is seated in the bore of the pin retainer with the projections of the head of the pin received in the recesses of the bore. Tension of the spring is adjustable by removing the fastener from the opposite end of the pin and withdrawing the projections of the head from engagement with the recesses of the bore of the first pin retainer, then rotating the head of the pin to wind or unwind the spring to adjust the tension of the spring, and then by installing the fastener onto the opposite end of the pin and positioning the projections of the head into engagement with the recesses of the bore of the first pin retainer, thereby fixing the tension of the spring at the adjusted tension.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
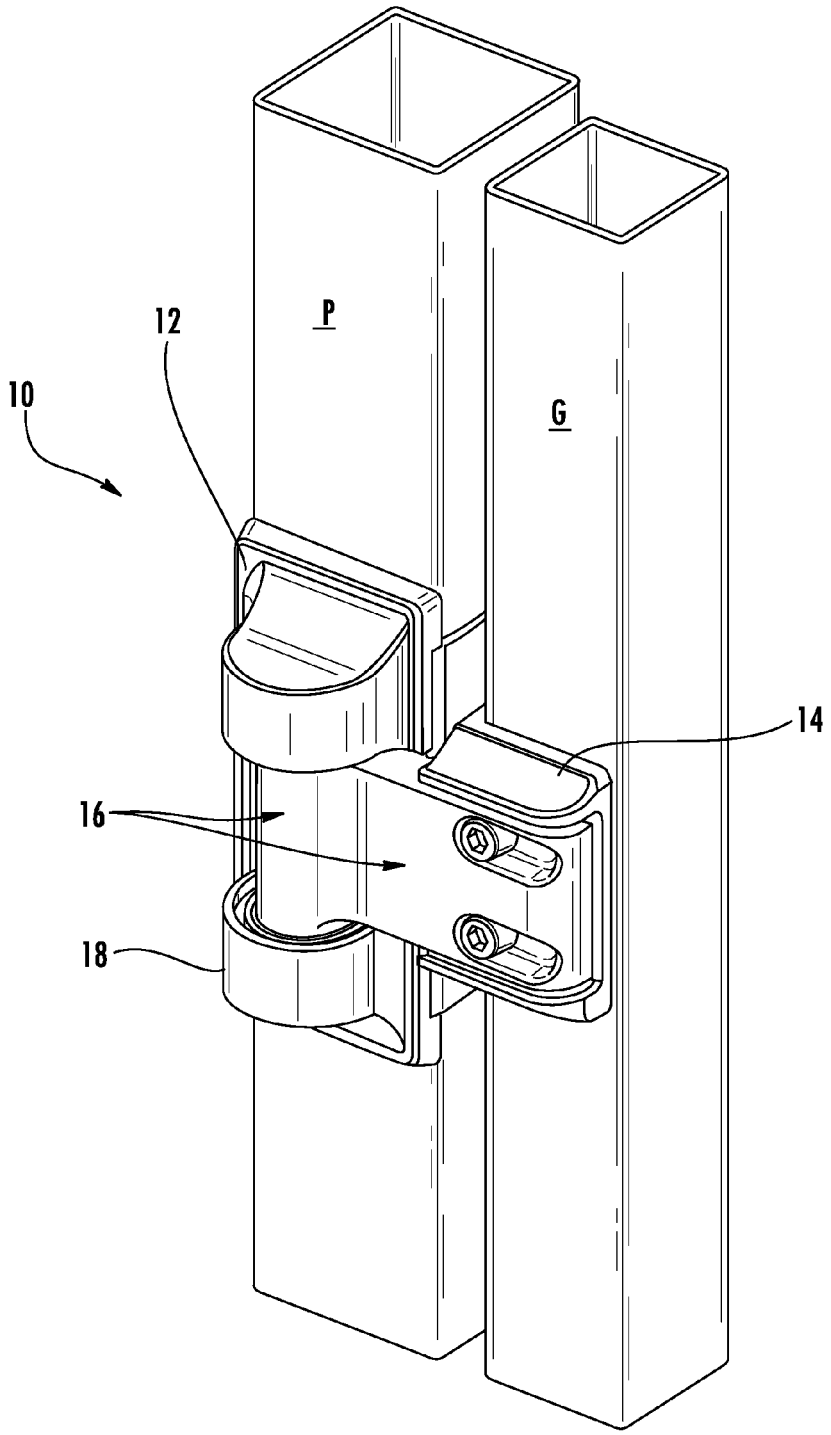
FIG. 1 is a perspective view of a fence hinge system according to the disclosure as mounted onto a fence post and fence gate.
Figure 2:
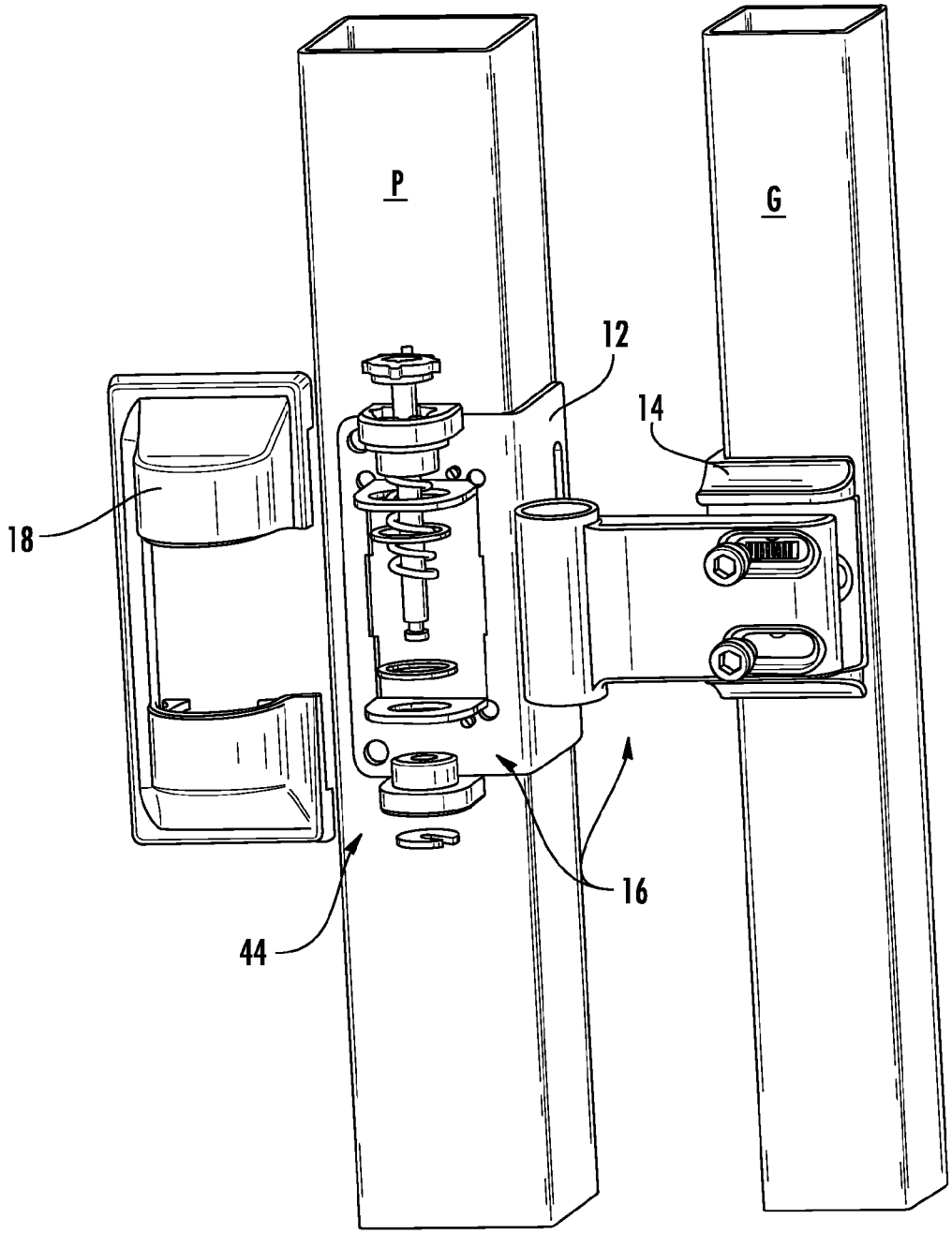
FIG. 2 is an exploded view of the fence hinge system of FIG. 1.

With initial reference to FIG. 1-2, the disclosure relates to an adjustable self-closing hinge system 10. The hinge system 10 is configured to enable an adjustable closing or opening tension. The term self-closing as used herein will be understood to encompass reverse mounting of the hinge so as to be self-opening.

The hinge system 10 is configured for mounting onto a body, such as a post P and/or a gate G of a fence, and includes a base plate 12, a swing arm 14, a hinge 16, and a hinge cover 18.

Figure 3:
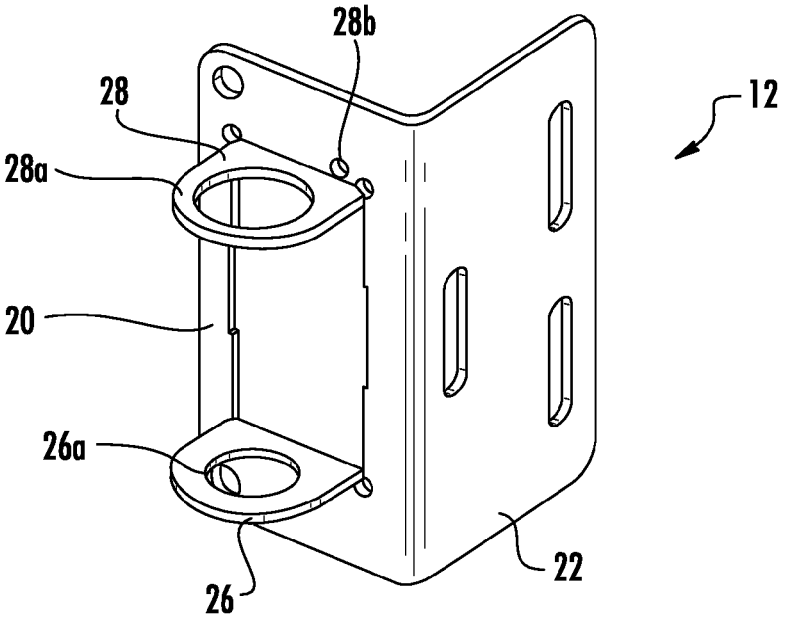
FIGS. 3 and 4 show front and rear views of a base plate component of the hinge system of FIG. 1.
Figure 4:
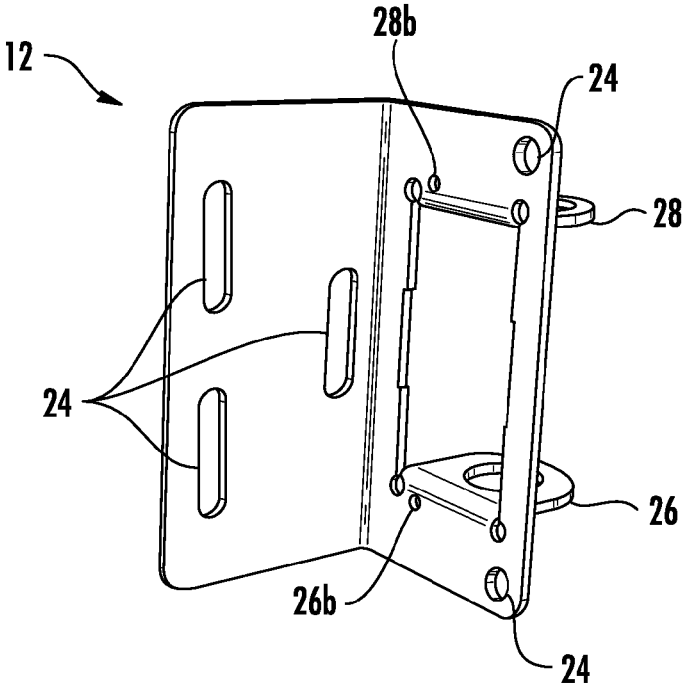
Figure 5:
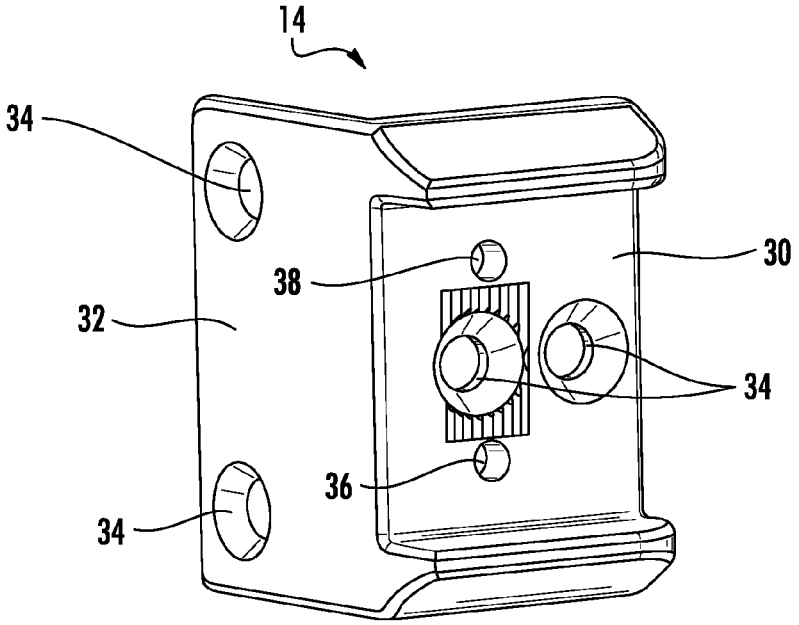
FIGS. 5 and 6 show front and rear views of a swing arm component of the hinge system of FIG. 1.
Figure 6:
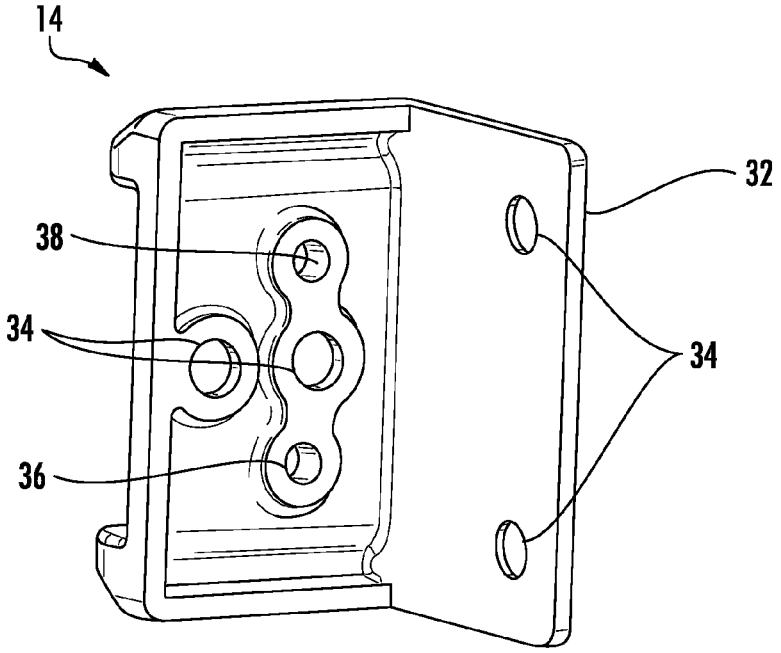
Figure 7:
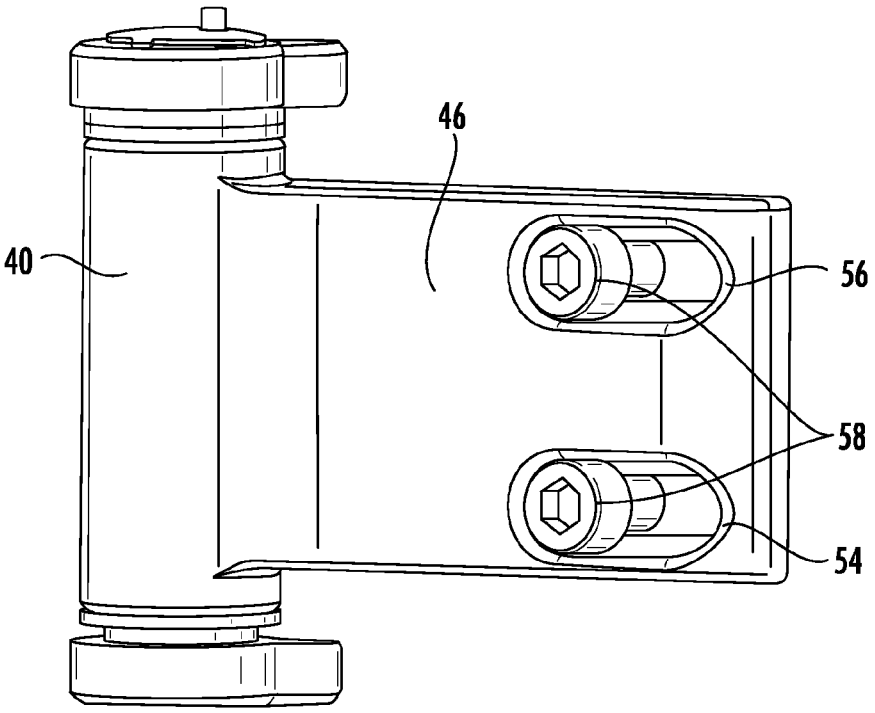
FIGS. 7 and 8 show front and rear assembled perspective views of hinge components of the hinge system of FIG. 1.

With additional reference to FIGS. 3-4, the base plate 12 is desirably of one-piece stamped metal construction and is configured for mounting onto the post P. In this regard, the base plate 12 includes a front wall 20 mountable to the front of the post P and a side wall 22 mountable to a side of the post adjacent the gate G. For use with a square post P, the front wall 20 and the side wall 22 generally form an angle of 90 degrees. The front wall 20 and the side wall 22 each include mounting apertures or slots, generally indicated by reference numeral 24, and configured for receiving fasteners such as screws for mounting the base plate 12 to the post. The front wall 20 includes outwardly extending and vertically spaced apart and aligned hinge mounts 26 and 28 onto which components of the hinge 16 are rotatably or pivotally mounted, as explained more fully below.

The mounts 26 and 28 may be formed from portions of the front wall 20 during manufacture of the base plate 12, and configured as plates extending from the front wall 20 with circular apertures located thereon for receiving components of the hinge 16. As shown, the mount 26 includes a small aperture 26*a*, and the mount 28 includes a larger aperture 28*a*, which cooperate for rotatably or pivotally mounting of the hinge 16. In addition, a hinge securing aperture 26*b* is formed in the front wall 20 adjacent the mount 26 for receiving a fastener for anchoring a portion of the hinge 16 to the front wall 20, as described below. Likewise, a hinge securing aperture 28*b* is formed in the front wall 20 adjacent the mount 28 for receiving a fastener for anchoring a portion of the hinge 16 to the front wall 20.

The swing arm 14 is desirably of one-piece metal construction and is configured for mounting onto the gate G. In this regard, the swing arm 14 includes a front wall 30 mountable to the front of the gate G and a side wall 32 mountable to a side or end of the gate G. The front wall 30 and the side wall 32 generally form an angle of 90 degrees. The front wall 30 and the side wall 32 each include mounting apertures, generally indicated by reference numeral 34, and configured for receiving fasteners such as screws for mounting the swing arm 14 to the gate. The front wall 30 includes threaded apertures 36 and 38 into which fasteners associated with the hinge 16 are threaded for mounting a portion of the hinge 16 to the swing arm 14, as described below.

With additional reference to FIGS. 7-12, the hinge 16 includes a tubular hinge housing 40 enclosing a spring 42, a spring adjustment system 44 operatively associated with the housing 40 and the spring 42, and an extension member 46 extending from the housing 40.

Figure 8:
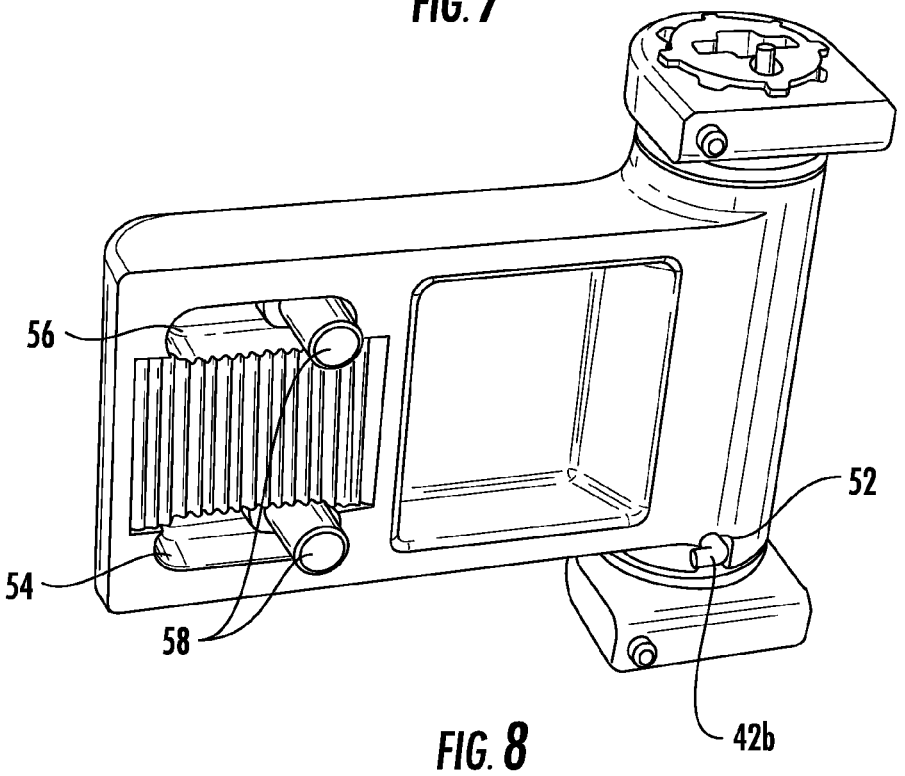
Figure 9:
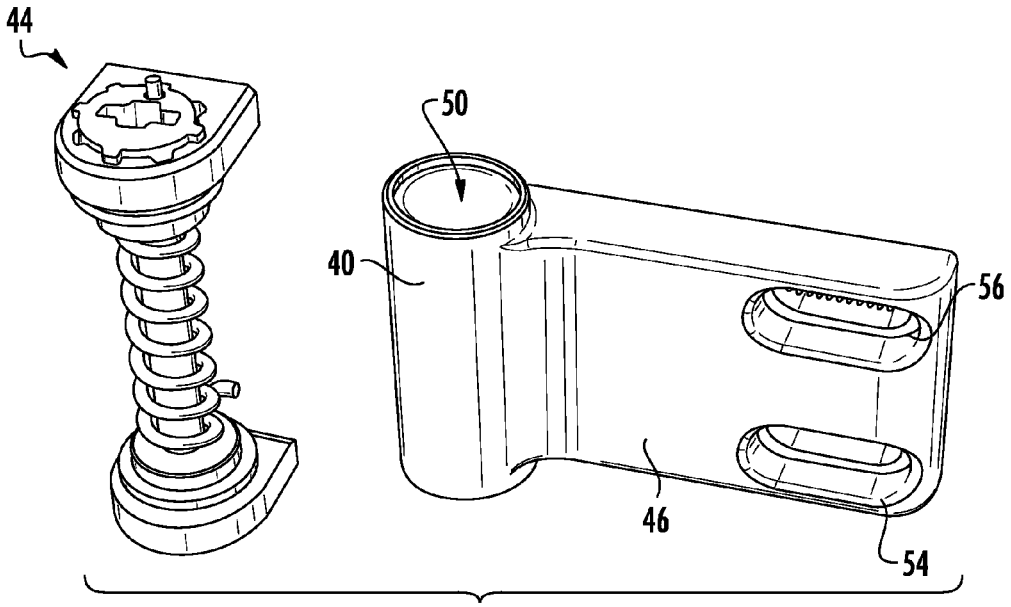
FIGS. 9-11 show partially exploded views of the hinge components of FIGS. 7 and 8.
Figure 10:
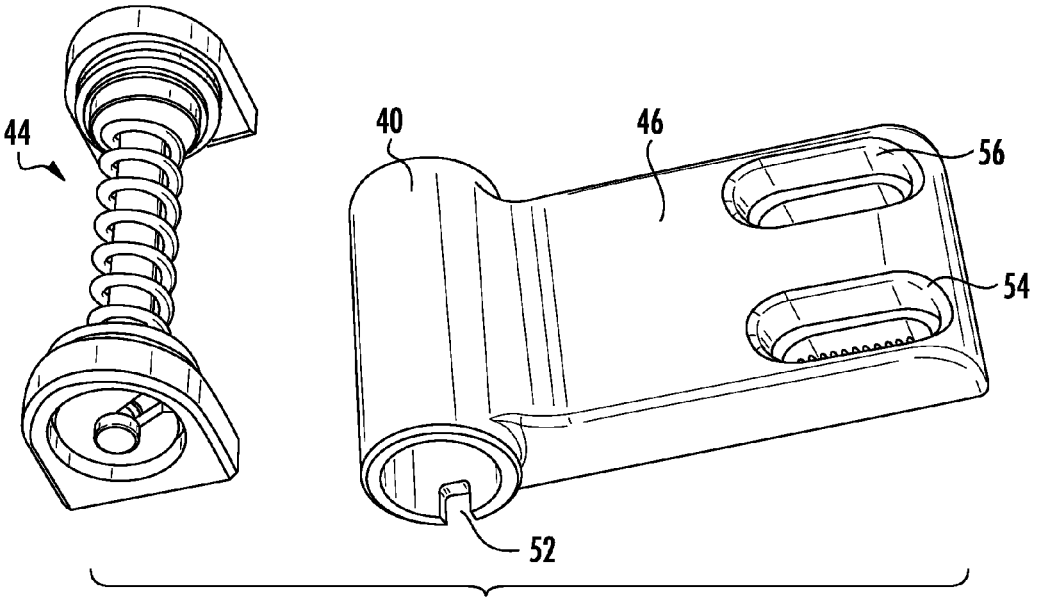
Figure 11:
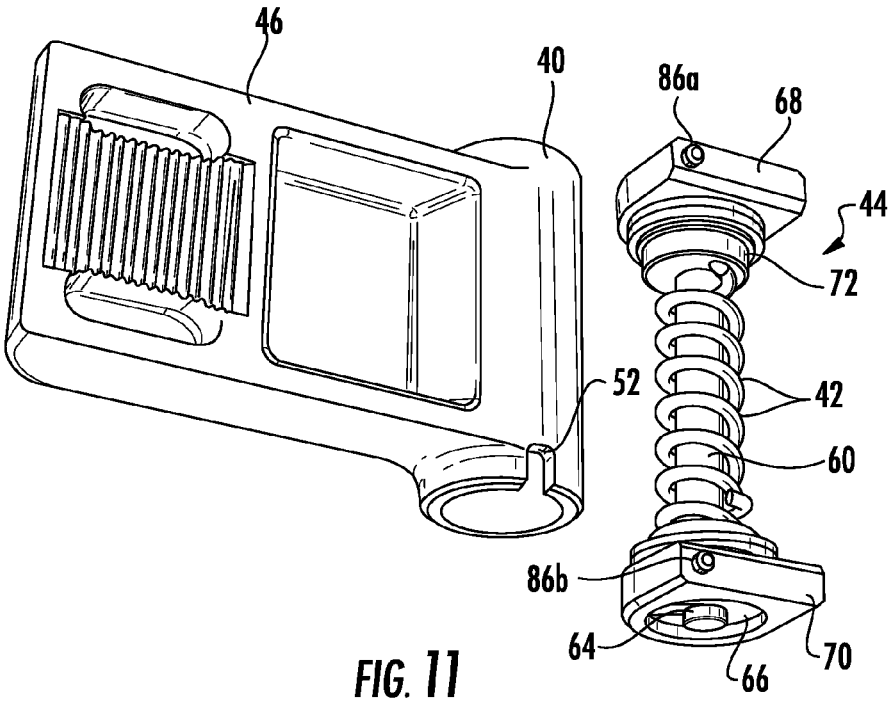
Figure 12:
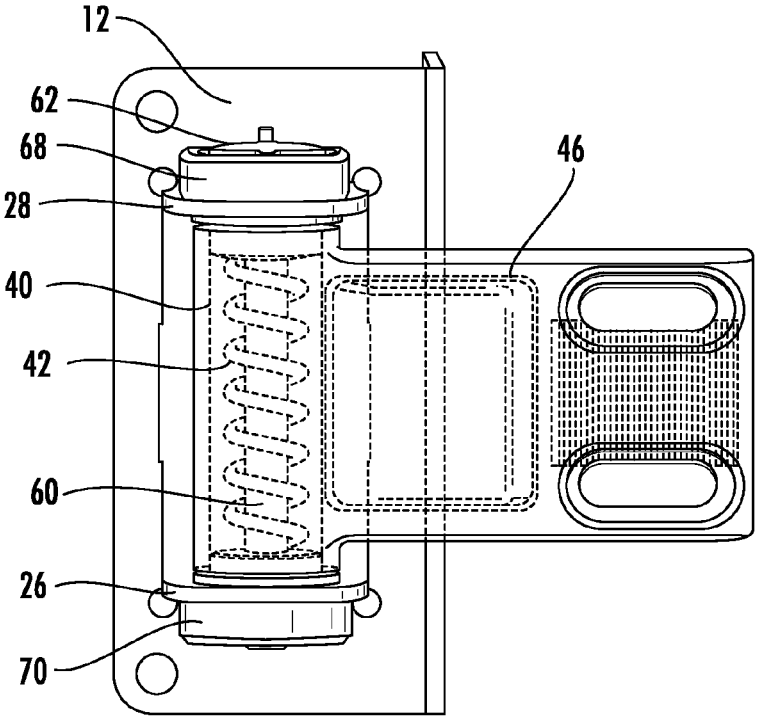
FIG. 12 shows the assembled hinge components of FIGS. 7 and 8, but with some of the components shown transparent.
Figure 13:
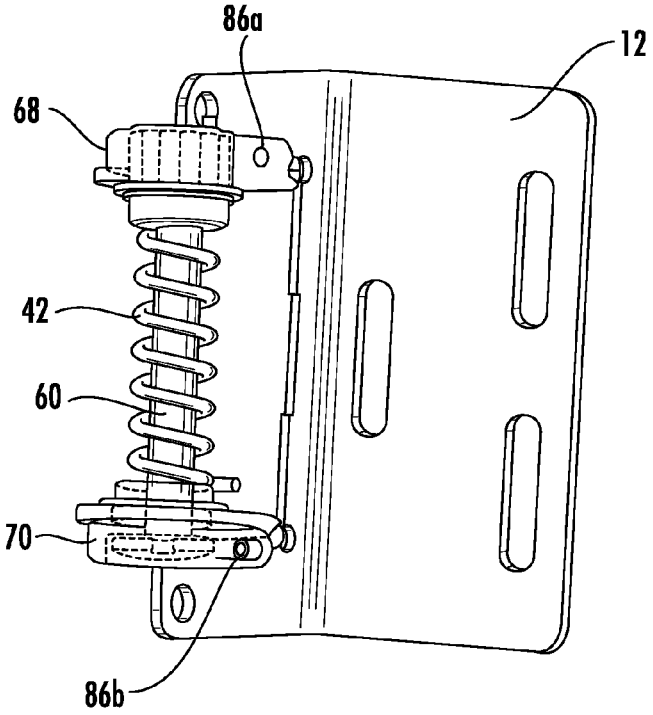
FIG. 13 shows portions of the hinge components as installed onto a base plate of the hinge system.
Figure 14:
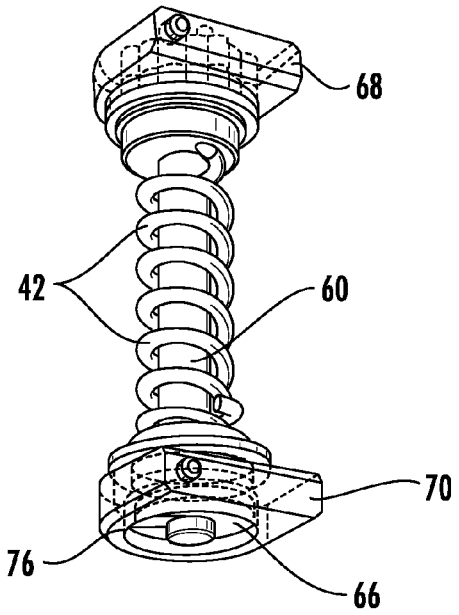
FIGS. 14 and 15 show partially assembled perspective views of hinge components, with some of the components shown transparent.
Figure 15:
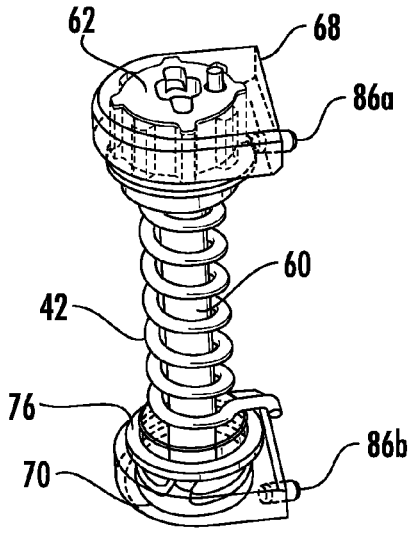
Figure 16:
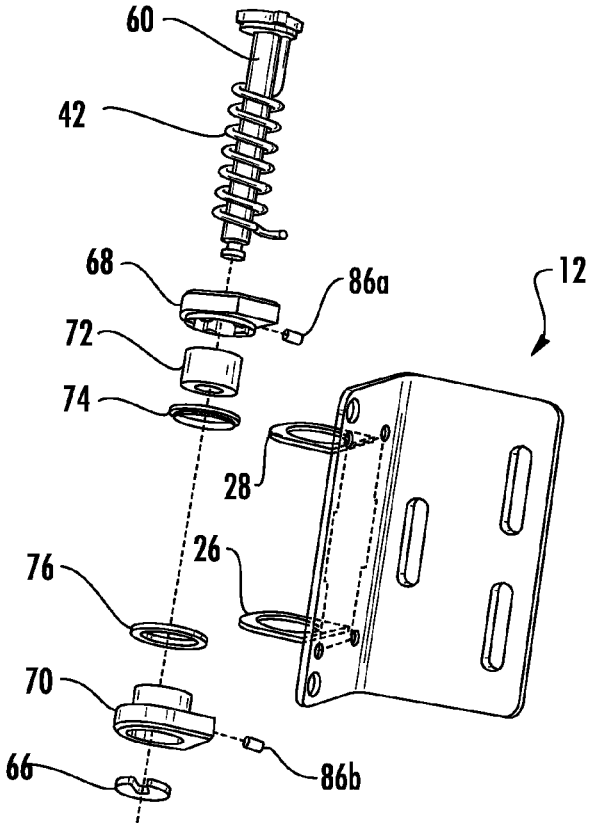
FIGS. 16 to 19 are exploded views showing hinge components.
Figure 17:
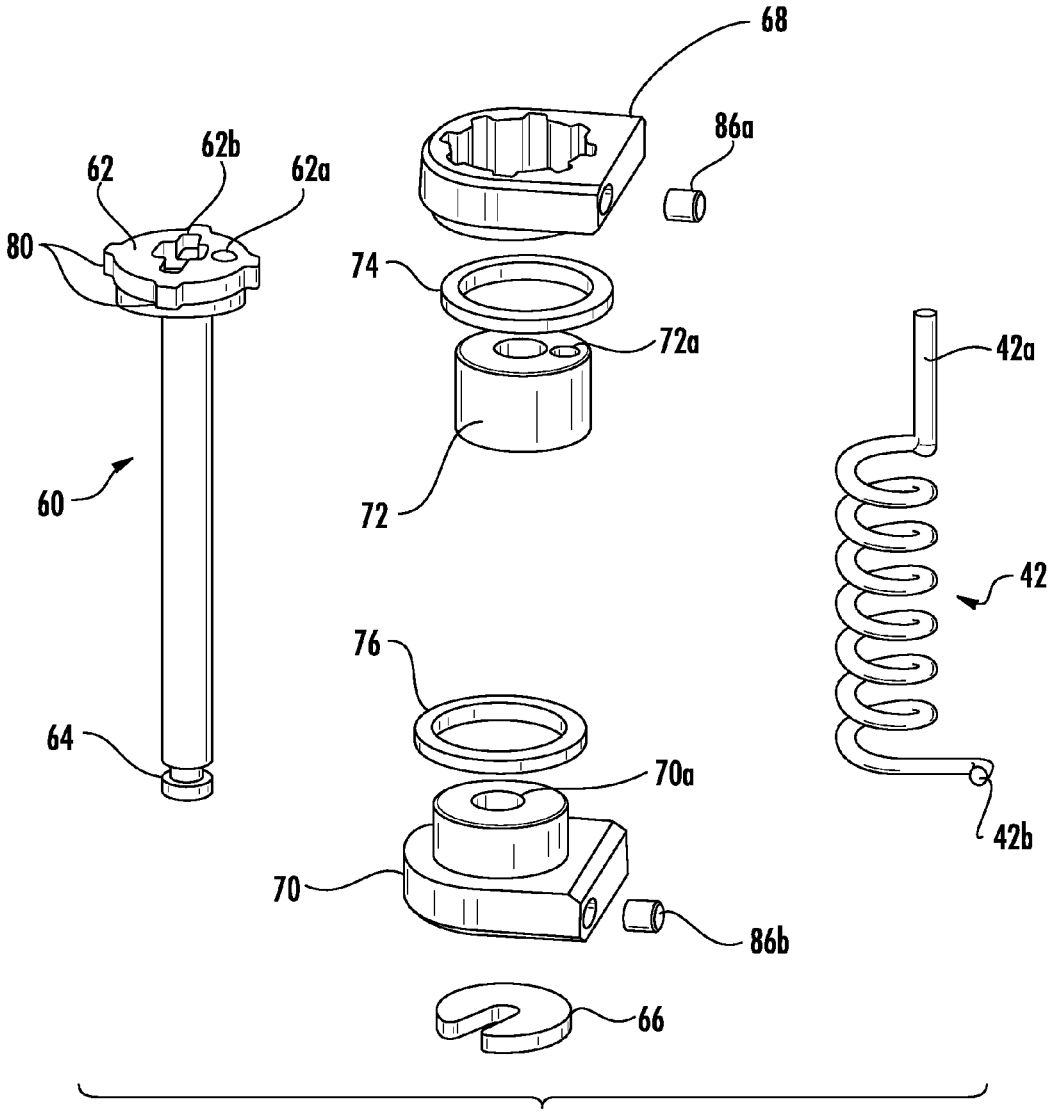
Figure 18:
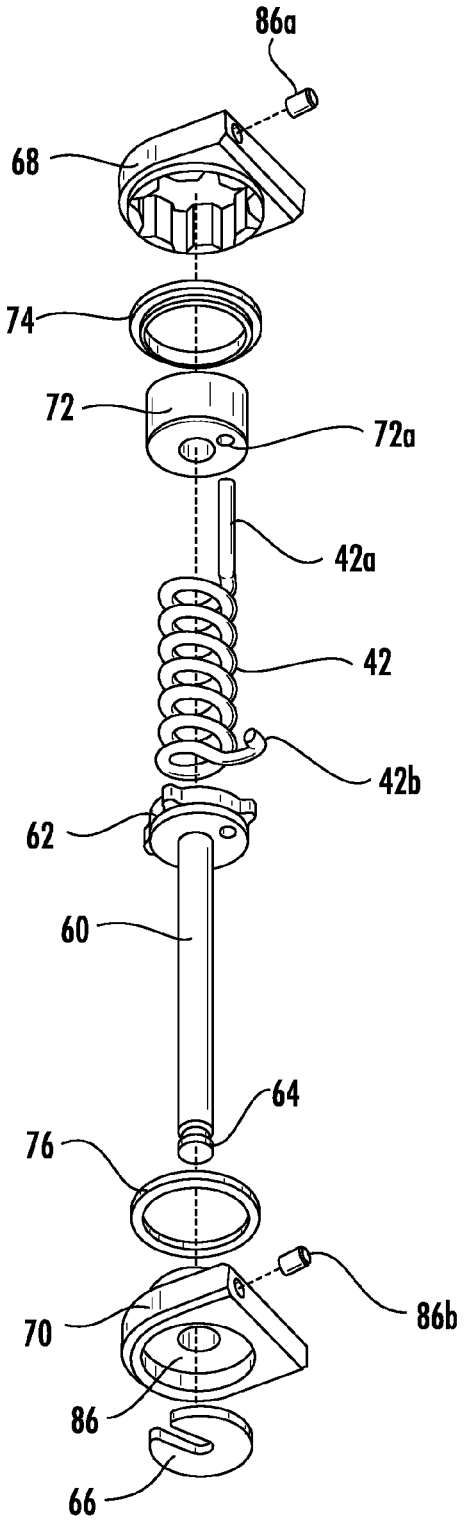
Figure 19:
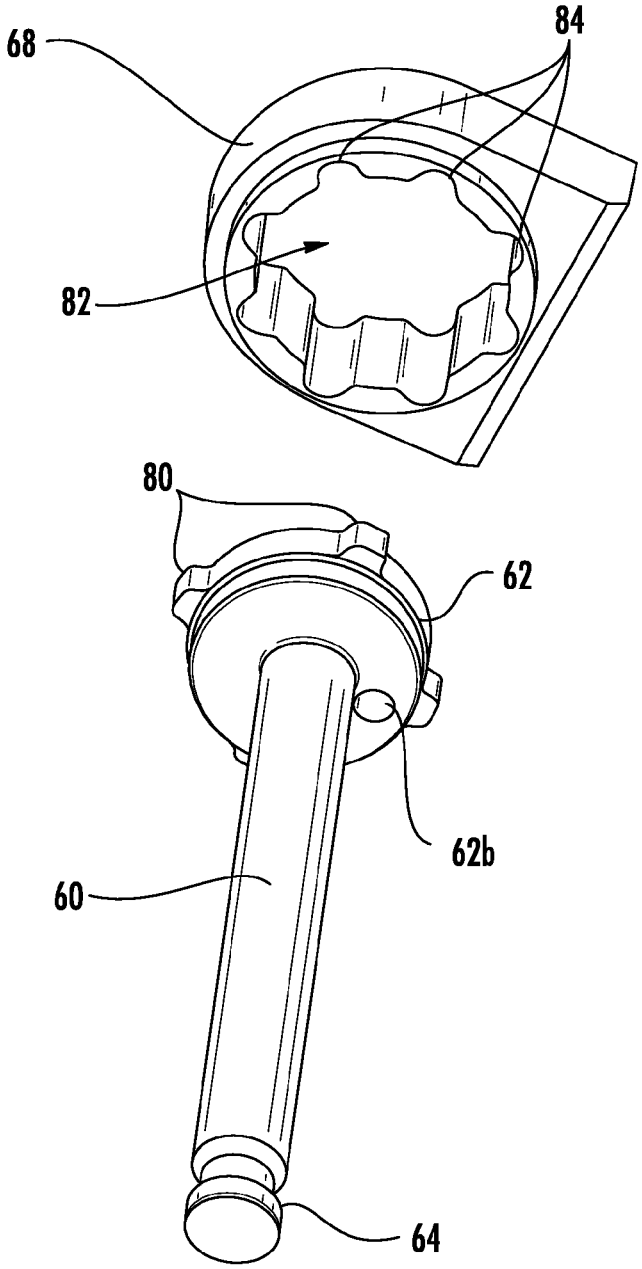

The tubular housing 40 is preferably of metal construction and includes a through bore 50 sized to receive the spring 42. The spring 42 is preferably a torsion spring having opposite ends 42*a* and 42*b*. A notch 52 is defined on the housing 40 at one end of the bore 50 for receiving the end 42*b* of the spring 42 (FIG. 8).

The extension member 46 may be attached to or co-formed with the housing 40.

The extension member 46 as shown is co-formed with the housing 40 and is a generally rectangular body having a pair of spaced apart and aligned slots 54 and 56 that are alignable with the apertures 36 and 38 of the swing arm 14. Fasteners 58 extend through the slots 54 and 56 and thread into the apertures 36 and 38 to adjustably attach the extension member 46 to the swing arm 14.

With additional reference to FIGS. 13-19, the spring adjustment system 44 includes an index pin 60 having a head 62 and an opposite grooved end 64 onto which is seated a fastener, such as a C-clip 66. The head 62 includes an aperture 62*a* extending through the thickness of the head 62 for receiving the end 42*a* of the spring 42. The head 62 also includes a drive surface 62*b* for receiving a driver head. For example, the drive surface 62*b* may be configured to have a slot for receiving a screwdriver blade and/or a hexagonal recess for receiving a hex key or Allen wrench, or other driver configuration.

The spring adjustment system 44 also includes a first pin retainer 68 configured to receive the head 62 of the index pin 60, a second pin retainer 70 configured to seat onto the housing 40 and receive the grooved end 64 of the index pin 60 and the C-clip 68, a plug 72 configured to fit within the housing 40 and having an aperture 72*a* for passage of the end 42*a* of the spring 42, and end gaskets 74 and 76 configured to rest on the ends of the housing 40.

The head 62 of the index pin 60 is configured to be adjustably and fixedly held by the pin retainer 68. That is, the pin retainer 68 prevents undesired rotation of the head 62 of the pin, but permits desired rotation for adjustment of spring tension. In this regard, the head 62 has a generally circular circumference but includes a plurality of projections 80. The projections 80 are preferably of uniform size and uniformly spaced about the circumference of the head 62. Correspondingly, the pin retainer 68 includes a generally circular bore 82 including a plurality of recesses 84. The bore 82 and the recesses 84 are configured so that the head 62 may be received by the bore 82 of the pin retainer 68, with each of the projections 80 received within one of the recesses 84. The number of the recesses 84 preferably exceeds the number of the projections 80 such that the index pin 60 may be incrementally positioned from one position to another. For example, as shown, the head 62 includes four of the projections 80, while the bore 82 includes eight of the recesses 84. Thus, the index pin 60 may be incrementally rotated as little as one-eighth of a turn during adjustment of the index pin 60 to tension or untension the spring 42 of the hinge 16, as explained more fully below. If desired, the projections 80 and the recesses 84 may be configured to enable even smaller adjustment increments.

The grooved end 64 of the index pin 60 is configured to be removably held by the pin retainer 70 so that the pin 60 may not be withdrawn from the housing 40. In this regard, the grooved end 64 of the index pin 60 is configured to extend through an aperture 70*a* of the pin retainer 70 sized to the index pin 60 and into an enlarged exterior recess 86 sized to receive the C-clip 66. Thus, the C-clip 66 as installed onto the grooved end 64 and located within the recess 86 of the pin retainer 70 prevents the grooved end 64 of the index pin 60 from being pulled past the pin retainer 70 and into the housing 40 of the hinge.

In the assembled state of the hinge 16, the hinge 16 is supported by and mounted onto the hinge mounts 26 and 28 of the base plate 12, with the pin retainers 68 and 70 being fixed to the base plate 12. The extension member 46 of the hinge 16 is mounted to the swing arm 14 by the fasteners 58 which extend through slots 54 and 56 of the extension member 46 and into threaded apertures 36 and 38 of the swing arm 14. The slots 54 and 56 of the extension member 46 enable the hinge 16 to be installed and adjusted to a variety of spacings between the post P of the fence and the gate G.

As installed onto the base plate 12, the housing 40 of the hinge 16, with the gaskets 74 and 76 located on the ends thereof, is rotatably positioned between the mounts 26 and 28 of the base plate 12, with the bore 50 of the housing 40 aligned with the apertures 26*a* and 28*a* of the mounts 26 and 28. The spring 42 is located within the housing 40, with the plug 72 located adjacent the end 42*a* of the spring 42. The pin retainer 68 is located opposite the plug 72 and seated onto the mount 28 and fixed to the base plate as by a set screw 86*a* extending through the aperture 28*b* of the base plate 12 and a corresponding aperture located on the pin retainer 68. The end 42*a* of the spring passes through the aperture 72*a* of the plug 72 and the aperture 62*a* of the head 62 of the index pin 60. The head 62 of the index pin 60 is seated in the pin retainer 68 as described above, and the index pin 60 extends through the coils of the spring 42. The grooved end 64 of the index pin 60 extends past the end 72*b* of the spring 42 and through the pin retainer 70 and is captured by the C-clip 66. The end 42*b* of the spring 42 is captured by the notch 52 of the housing 40. The retainer 70 is likewise seated onto the mount 26 and fixed to the base plate 12 as by a set screw 86*b* extending through the aperture 26*b* of the base plate 12 and a corresponding aperture located on the pin retainer 70.

Figure 20:
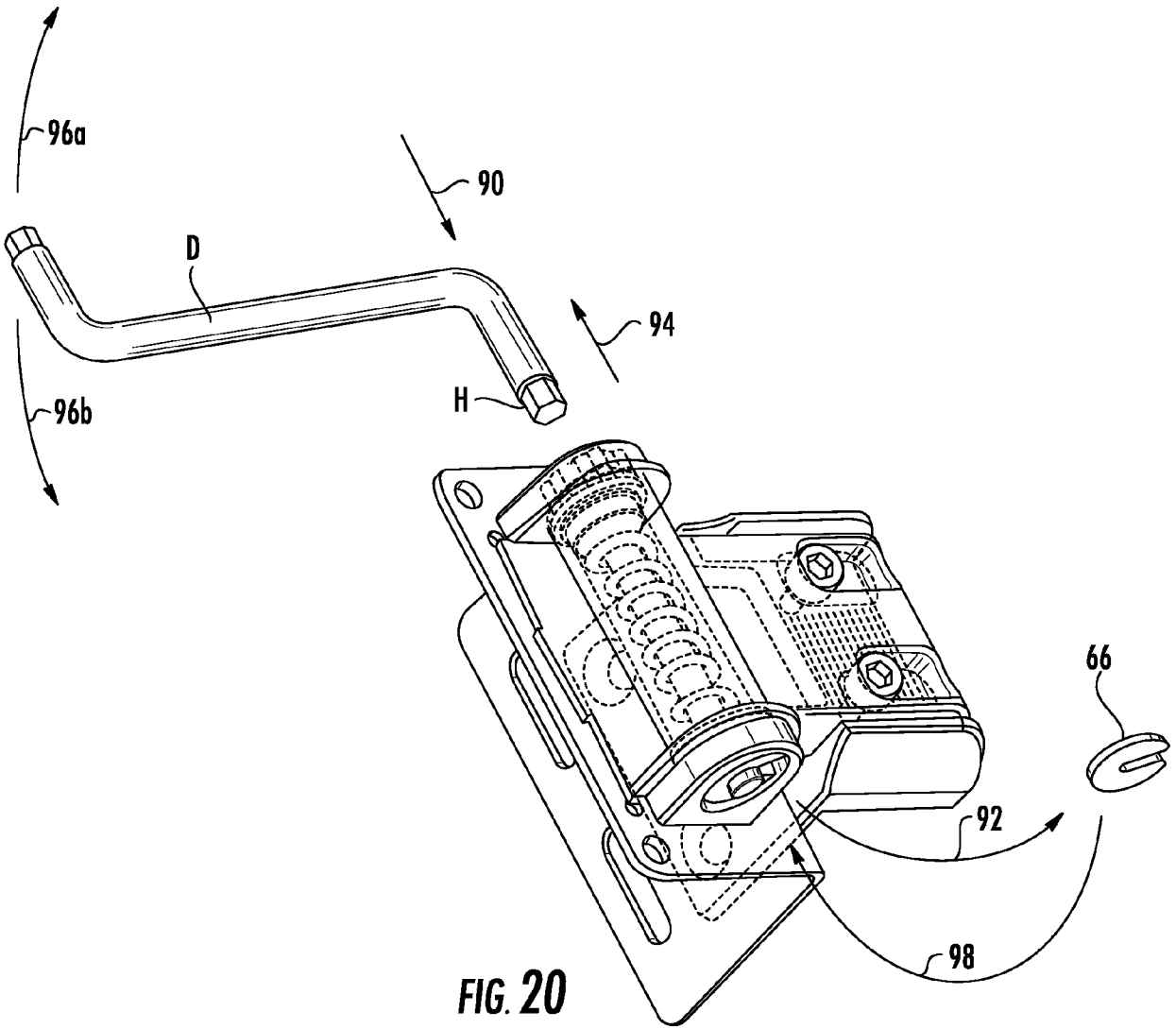
FIG. 20 shows adjustment of spring tension of the hinge system of FIG. 1.

With reference to FIG. 20, there are shown example steps for adjustment of the tension of the spring 42. In a first step, as represented by reference numeral 90, a head H of a driver D, such as an Allen wrench is engaged with the drive surface 62*b* of the head 62 of the index pin 60. Force is exerted to urge the head 62 in the direction of the spring 42 to urge the plug 72 against the spring 42 and compress the spring 42 so that the grooved end 64 of the index pin 60 with the C-clip 66 thereon emerges from the recess 86 of the pin retainer 70, yet the head 62 of the index pin 60 is still prevented from turning by the recesses 86 of the retaining pin 68. The force on the driver is maintained and, as represented by reference numeral 92, the C-clip 66 is removed from the grooved end 64 of the index pin 60. Next, as represented by reference numeral 94, the force is removed from the driver D and the spring 42 is decompressed and the head 62 of the index pin 60 is slightly ejected from the bore 82 of the pin retainer 68 so as to be free to turn. The driver D is then used to either further wind the spring 42 or unwind the spring 42 a desired amount, as represented by reference numerals 96*a* and 96*b*. Once the spring tension is adjusted, the step represented by reference numeral 90 is repeated to urge the grooved end 64 of the index pin back out of the recess 86. Then, as represented by reference numeral 98, pressure is maintained on the driver D to keep the grooved end 64 exposed and the C-clip 66 is re-installed onto the grooved end 64 of the index pin. Once the C-clip 66 is installed, the driver D may be released from the head 62 and the index pin 60 will remove to its seated position within the pin retainer 68, with the spring 42 adjusted to its new tension.

In regard to tightening or loosening of the spring 42, in either case, the adjustment of the index pin 60 by turning the head 62 should be limited to no more than about one-quarter of a turn. For the configuration of the head 62 and the bore 80 noted above, one-quarter turn would correspond to one of the projections 80 moving into one of the recesses 84 of the pin retainer 70 located two away from the starting recess 84 of the projection. It is preferred that indicium or indicia, such as plus (+) and minus (−) symbols be provided on the exterior of the pin retainer 70 to indicate which direction to rotate the head 62 to tighten or loosen the spring 42.

To disable the self-closing or self-opening feature of the hinge system 10, the above described procedure is accomplished, except that the head 62 is turned one full turn from the fully tensioned position to substantially untension to the spring. To re-engage the self-closing feature, the procedure is reversed and the head 62 is turned one full turn form the disabled position to return the spring to the fully tensioned state. If desired, the tension may then be reduced as described above.

Once the spring tension is desirably adjusted, the cover 18 is installed by snap fitting onto the housing 40. In this regard, the cover 18 is configured to cooperate with the hinge 16 for facilitating customization of the hinge 16 and improving aesthetics of the installed hinge 16. The cover 18 is configured to mount onto the housing 40 of the hinge 16 and substantially cover portions of the hinge 16 associated therewith and the base plate 12. The cover 18 may be of one-piece construction, preferably of molded plastic, and includes a pair of vaulted interior surfaces spaced apart from one another by a gap. Each of the interior surface includes a semi-circular clip located thereon and are aligned and configured to clip onto the housing 40 of the hinge 16 in a snap-fit relationship to secure the cover 18 onto the hinge 16. The gap is located so as to provide clearance for operation of the hinge 16, such that as the hinge 16 pivots in operation of opening and closing, the extension member 46 can travel unobstructed by the cover 18. The cover 18 is configured to include a decorative and ornamental exterior configured to substantially cover the base plate 12 and portions of the hinge 16 associated with the base plate 12.

As will be appreciated, the described hinge system 10 advantageously provides a fence hinge system configured to have an adjustable closing (or opening) tension and which utilizes a decorative cover for facilitating customization of the fence hinge and improving aesthetics of the installed fence hinge.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An adjustable self-closing fence hinge system, the hinge system comprising:

a base plate attachable to a fence post, the base plate comprising a first wall mountable to the fence post and a pair of vertically spaced apart and aligned first hinge mounts extending outwardly from the first wall;

a swing arm attachable to a fence gate, the swing arm comprising a second wall mountable to the gate;

a hinge mounted to the base plate and the swing arm for hingedly connecting the base plate and the swing arm, the hinge comprising:

a hinge housing vertically oriented and rotatably mounted to the first hinge mounts, an extension member having a first portion connected to the hinge housing and a second portion mounted to the swing arm;

a spring located within the hinge housing, the spring having a first end and an opposite second end, the second end of the spring being fixed relative to the hinge housing, and a spring adjustment system, the spring adjustment system comprising:

a pin having a head including a plurality of projections about a circumference of the head and an opposite end of the pin spaced from the head, the pin positioned to cooperate with the spring so that the first end of the spring is fixed relative to the head of the pin so that when the head of the pin is rotated the first end of the spring also rotates, a fastener removably positionable adjacent the opposite end of the pin, and a first pin retainer fixedly located adjacent an end of the housing and including a bore configured to receive the head of the pin, the bore including a plurality of recesses configured to receive the projections of the head of the pin, wherein tension of the spring is fixed when the pin head is seated in the bore of the pin retainer with the projections of the head of the pin received in the recesses of the bore, and wherein tension of the spring is adjustable by removing the fastener from the opposite end of the pin and withdrawing the projections of the head from engagement with the recesses of the bore of the first pin retainer, then rotating the head of the pin to wind or unwind the spring to adjust the tension of the spring, and then by installing the fastener onto the opposite end of the pin and positioning the projections of the head into engagement with the recesses of the bore of the first pin retainer, thereby fixing the tension of the spring at the adjusted tension.

2. The fence hinge system of claim 1, wherein the hinge housing is tubular.

3. The fence hinge system of claim 2, wherein the second end of the spring is fixed relative to the hinge housing by positioning the second end of the spring within a notch defined on the housing.

4. The fence hinge system of claim 1, wherein the head of the pin includes an aperture and the first end of the spring is fixed relative to the head of the pin by passing the first end of the spring into the aperture of the head of the pin.

5. The fence hinge system of claim 1, wherein the spring is an elongate torsion spring and the spring surrounds portions of the pin.

6. The fence hinge system of claim 1, further comprising a second pin retainer fixedly located adjacent an opposite end of the housing and including a through bore for passage of the pin and an enlarged exterior recess configured to receive the opposite end the pin and the fastener when it is installed onto the opposite end of the pin.

7. The fence hinge system of claim 1, wherein the first pin retainer is fixedly located adjacent the housing by a second fastener extending between the base plate and the first pin retainer.

8. The fence hinge system of claim 1, wherein the spring tension may be adjusted to substantially untension the spring so that the hinge system is no longer self-closing.

9. An adjustable self-closing hinge, the hinge comprising:

a hinge housing rotatably mountable relative to a body by a hinge mount;

a spring located within the hinge housing, the spring having a first end and an opposite second end, the second end of the spring being fixed relative to the hinge housing; and a spring adjustment system, the spring adjustment system comprising:

a pin having a head including a plurality of projections about a circumference of the head and an opposite end of the pin spaced from the head, the pin positioned to cooperate with the spring so that a first end of the spring is fixed relative to the head of the pin so that when the head of the pin is rotated the first end of the spring also rotates, a fastener removably positionable on the opposite end of the pin, and a first pin retainer fixedly located adjacent an end of the housing and including a bore configured to receive the head of the pin, the bore including a plurality of recesses configured to receive the projections of the head of the pin, wherein tension of the spring is fixed when the pin head is seated in the bore of the pin retainer with the projections of the head of the pin received in the recesses of the bore, and wherein tension of the spring is adjustable by removing the fastener from the opposite end of the pin and withdrawing the projections of the head from engagement with the recesses of the bore of the first pin retainer, then rotating the head of the pin to wind or unwind the spring to adjust the tension of the spring, and then by installing the fastener onto the opposite end of the pin and positioning the projections of the head into engagement with the recesses of the bore of the first pin retainer, thereby fixing the tension of the spring at the adjusted tension.

10. The fence hinge system of claim 9, wherein the second end of the spring is fixed relative to the hinge housing by positioning the second end of the spring within a notch defined on the housing.

11. The fence hinge system of claim 9, wherein the head of the pin includes an aperture and the first end of the spring is fixed relative to the head of the pin by passing the first end of the spring into the aperture of the head of the pin.

12. An adjustable hinge, the hinge comprising:

a hinge housing rotatably mountable relative to a body;

a spring located within the hinge housing, the spring having a first end and an opposite second end, the second end of the spring being fixed relative to the hinge housing; and a spring adjustment system, comprising:

a pin having a head including a plurality of projections about a circumference of the head and an opposite end of the pin spaced from the head, the pin positioned to cooperate with the spring so that a first end of the spring is fixed relative to the head of the pin so that when the head of the pin is rotated the first end of the spring also rotates, and a pin retainer fixedly located relative to the housing and including a bore configured to receive the head of the pin, the bore including a plurality of recesses configured to receive the projections of the head of the pin, wherein tension of the spring is fixed when the pin head is seated in the bore of the pin retainer with the projections of the head of the pin received in the recesses of the bore, and wherein tension of the spring is adjustable by withdrawing the projections of the head from engagement with the recesses of the bore of the pin retainer, then rotating the head of the pin to wind or unwind the spring to adjust the tension of the spring, and then positioning the projections of the head into engagement with the recesses of the bore of the pin retainer, thereby fixing the tension of the spring at the adjusted tension.

* * * * *